United States Patent [19]

Heberlein, Jr. et al.

[11] Patent Number: 4,785,288

[45] Date of Patent: Nov. 15, 1988

[54] MODULAR SMOKE DETECTOR

[75] Inventors: G. Erich Heberlein, Jr., Delafield; Gary P. Bruski, Wauwatosa, both of Wis.

[73] Assignee: Allen-Bradley Company, Inc., Milwaukee, Wis.

[21] Appl. No.: 80,530

[22] Filed: Jul. 31, 1987

[51] Int. Cl.[4] ..... G08B 17/10

[52] U.S. Cl. ..... 340/628; 340/629; 312/107

[58] Field of Search ..... 340/627, 628, 629; 73/16, 23; 361/384, 385; 169/45, 54, 51, 60, 61, 65, 56; 312/31.3, 294, 299, 107, 223, 308, 352

[56] References Cited

U.S. PATENT DOCUMENTS

| | | | |
|---|---|---|---|
| 3,943,499 | 3/1976 | Dunphy | 340/227 R |
| 3,952,808 | 4/1976 | Richardson | 169/61 |
| 3,953,844 | 4/1976 | Barr et al. | 340/627 |
| 4,254,414 | 3/1981 | Street et al. | 340/627 |
| 4,364,032 | 12/1982 | Narato et al. | 340/679 |
| 4,447,846 | 5/1984 | McCleery | 361/90 |
| 4,615,224 | 10/1986 | Smith et al. | 73/863.33 |
| 4,616,694 | 10/1986 | Hsieh | 361/384 |
| 4,630,037 | 12/1986 | Escamilla | 340/628 |

FOREIGN PATENT DOCUMENTS

| | | |
|---|---|---|
| 2846310 | 4/1980 | Fed. Rep. of Germany . |
| 3433459 | 3/1986 | Fed. Rep. of Germany . |

*Primary Examiner*—Joseph A. Orsino
*Assistant Examiner*—Jill D. Jackson
*Attorney, Agent, or Firm*—Quarles & Brady

[57] ABSTRACT

A modular smoke detector is adapted for mounting in an electrical equipment cabinet. The smoke detector module is of a standard size and configuration, thereby facilitating mounting anywhere in the cabinet. A mounting location near the bottom of the equipment cabinet is preferred to better detect the heavier than air combustion products of smoldering or burning insulation. The modular smoke detector includes a commercial ionization type detector and a fan. The fan induces air from the interior of the equipment cabinet into the module. The fan is positioned such that it does not discharge directly onto the ionization detector to prevent excessive speed of the air through the ionization detector.

6 Claims, 2 Drawing Sheets

MODULAR SMOKE DETECTOR

BACKGROUND OF THE INVENTION

The field of the invention is smoke detectors and, more particularly, smoke detectors for electrical equipment cabinets.

Commercial smoke detectors have been included in the design and installation of switch gear rooms for years. It has been assumed that the use of pendent smoke detectors provides adequate monitoring for the detection of smoke and fire in the switch gear rooms. However, such pendent mounted smoke detectors have failed to provide adequate early warning for the protection of the electrical equipment.

From experience it has been determined that the majority of smoke filled switch gear rooms are the result of electrical equipment smoldering or burning inside the switch gear. Many of the causes of insulation failure leading to such smoldering or burning have not been from short circuit problems, but rather from more subtle problems which cause excessive heating without tripping overload devices. Examples of such subtile problems include poor terminations, loose connections, misapplication of overload devices, device malfunctions, insulation breakdown of coils or control transformers, and tracking due to moisture and contamination. In addition, where there are environmental problems, such as humid locations, or where there is no provision of a controlled environment, corrosion has been a significant factor in termination problems which have led to smoldering or burning insulation.

To address such problems, maintenance programs have been established, usually consisting of surveillance and maintenance operations, including torquing of termination hardware, and infrared monitoring and photographs. All of these programs are proactive in covering an essential part of protecting the electrical equipment. Currently available reactive systems, for example, short circuit and ground fault protection, provide protection against the catastrophic failures which they are designed to protect, but do nothing to detect severe overheating caused by the factors mentioned above.

For example, a typical progression of an insulation failure is as follows. A loose connection can occur over years of service in an equipment cabinet. The loose connection can be caused by load cycling and cold flow of the conductor material in the termination, or by corrosion due to environmental conditions. In either of these cases there is not an overload condition, and thus the overload monitoring devices do not trip.

The connection point then becomes extremely hot due to the high resistance of the poor connection. With the high temperatures, the insulation of the conductors comprising the connection begins to break down and eventually will smolder or burn. This condition may escalate until there is a runaway situation in which the insulation completely fails and an arcing ground fault or phase-to-phase fault occurs. The result of such a failure is serious equipment damage as well as down time.

Conventional smoke detection systems have been particularly ineffective in detecting smoldering or burning insulation early enough to prevent such runaway failures.

SUMMARY OF THE INVENTION

A modular smoke detector of the present invention includes a smoke detector mounted on a frame. The frame conforms to a standard mounting for modules in an equipment cabinet, and therefore may be installed in any arbitrary location in the equipment cabinet. The frame also includes an air inlet for admitting air from the interior of the equipment cabinet to the smoke detector.

A primary object of this invention is to provide early detection of insulation failure before the insulation completely breaks down and leads to more severe damage to the equipment cabinet. The modular smoke detector may therefore by placed in a location which is most suitable for detecting smoldering or burning insulation in the early stages of combustion before more serious damage occurs.

Another object of this invention is to provide a low cost, modular smoke detector which may be easily installed in the equipment cabinet at a location which will provide for the earliest possible detection of insulation combustion products. The modular assembly of the modular smoke detector allows it to be installed as easily as other modules within the switch gear. If the switch gear is very large or contains air restricting partitions, then more than one modular assembly may be provided to more quickly respond to insulation combustion products.

Early detection of the products of insulation combustion products is an important advantage of this invention. In order to provide the earliest possible detection of such combustion products, the modular assembly may include a fan for drawing air from the interior of the switch gear into the modular smoke detector. The fan is oriented so that it does not discharge directly onto the smoke detector. Excessive air speed through the smoke detector which may delay its response time is thereby prevented.

The foregoing and other objects and advantages of the invention will appear from the following description. In the description, reference is made to the accompanying drawings which form a part hereof, and in which there is shown by way of illustration a preferred embodiment of the invention. Such embodiment does not necessarily represent the full scope of the invention, however, and reference is made therefore to the claims herein for interpreting the scope of the invention.

DESCRIPTION OF THE PREFERRED EMBODIMENT

Figure 1:
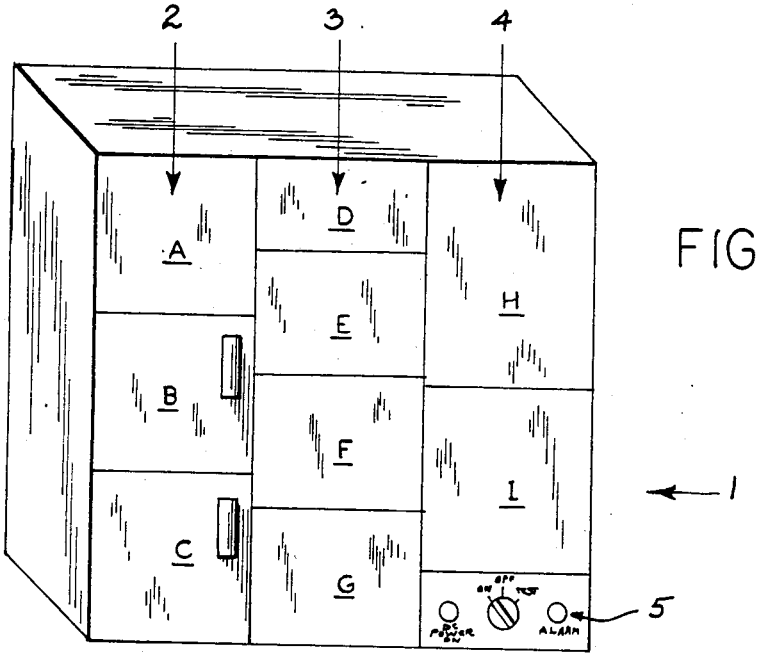
FIG. 1 is a perspective view of a motor control center which includes a modular smoke detector of the present invention.

Referring to FIG. 1, a motor control center 1 includes three bays 2, 3, and 4, respectively, for the mounting of electrical equipment. The bays 2–4 are set up to accept modules A-I, each of which is one of a variety of standard sizes. Each of the modules A-I performs a certain function in the motor control center utilizing standard devices such as, for example, disconnect switches, motor starters, and control circuits.

Blank panels may be used to close off any openings not occupied by one of the standard modules.

A modular smoke detector 5 conforms to the same standard mounting techniques as the other modules A-I, and so may be located anywhere within the motor control center 1. The flexibility to locate the modular smoke detector 5 at any arbitrary location within the motor control center 1 is an important aspect of this invention, as it allows the modular smoke detector 5 to be easily placed at a location which is the most advantageous for early detection of insulation combustion products.

Normally, smoke detectors are mounted in fixed locations and are located high on the walls or ceiling of equipment rooms, or on the top of equipment cabinets. It is an important teaching of this invention that such high locations for smoke detectors are particularly ineffective in detecting insulation combustion products. The combustion products produced by smoldering or burning insulation are heavier than air and tend to settle downward rather than up. The earliest detection of such insulation combustion products is achieved by placing the modular smoke detector 5 low, at the bottom of the motor control center 1. If the bays 2–4 are open to each other, a single modular smoke detector 5 according to this invention has been found to be satisfactory for installations of approximately five bays.

Because of the modular construction of the smoke detector 5, more than one modular smoke detector 5 may be easily placed within the motor control center 1. For example, if the bays 2–4 contain air restricting partitions, then a modular smoke detector 5 may be placed at the bottom of each bay 2–4 and connected so that a fault in any of the modular smoke detectors 5 would indicate a fault condition to a control system (not shown). Similarly, if a large number of bays are used, multiple modular smoke detectors 5 may be placed as needed to ensure rapid response.

Figure 1A:
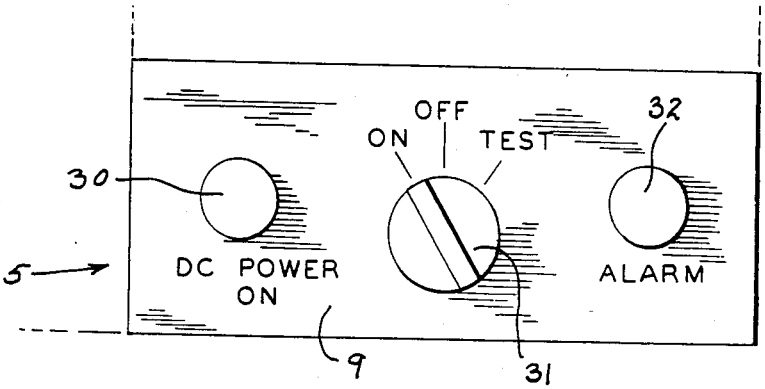
FIG. 1A is a detailed view of the front panel of the modular smoke detector of FIG. 1.

Referring to FIG 1A, the modular smoke detector 5 includes a front panel 9 for mounting displays 30 and 32, and a control switch 31. As described in detail below, switch 31 has three positions: ON, OFF, and TEST. Indicator 30 is a "DC POWER ON" indicator, while indicator 32 is illuminated only when a fault is detected.

Figure 2:
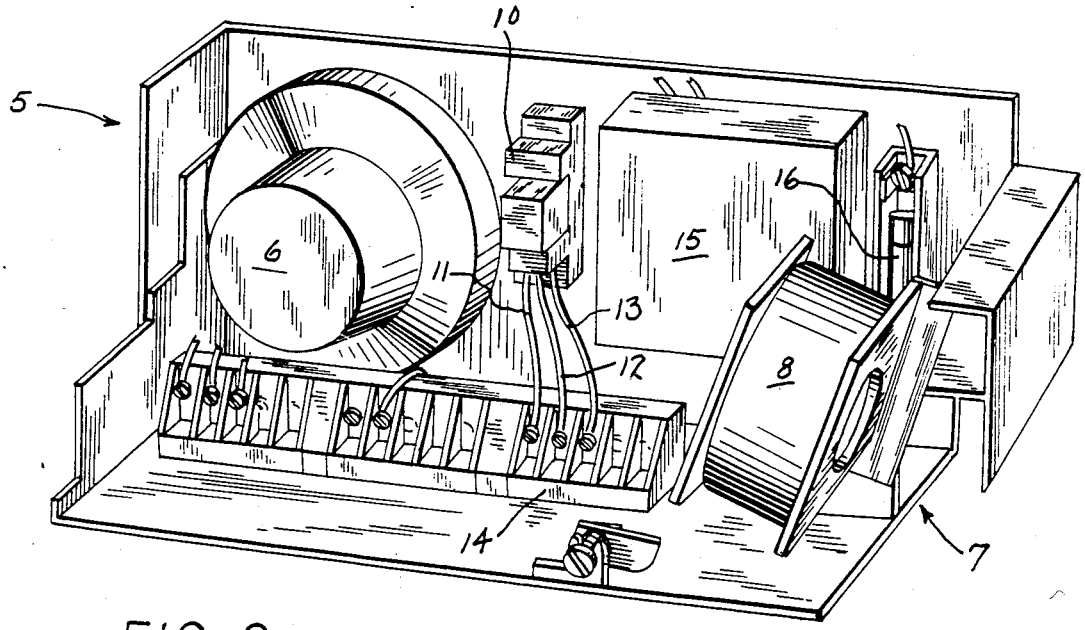
FIG. 2 is a detailed view of the modular smoke detector of FIG. 1 removed from the motor control center.

Referring to FIG. 2, the components within the modular smoke detector 5 and their layout within the module are as follows. The actual detection is performed by a model 602U ionization type detector 6, manufactured by Electro Signal Lab, Inc. The ionization detector 6 is mounted on one end of the module 5. Air from the interior of the motor control center 1 enters the module 5 through an inlet 7 on the end of the module 5 opposite the ionization detector 6.

A fan 8 is placed near the opening 7 to assist drawing air into the module 5. Another teaching of this inventions is that while a fan 8 is desirable to insure induction of insulation combustion products, the fan 8 must not be allowed to produce excessive air flow across the ionization detector 6. Otherwise, sparse insulation combustion products may not linger in the detection chamber for a time period exceeding the reaction time of the ionization detector 6. It would then require substantially higher concentrations of the insulation combustion products to trigger the ionization detector 6.

In order to provide the earliest possible detection of insulation combustion products, this invention controls the discharge from the fan 8 so that excessive air flow across the ionization detector 6 is prevented. This is accomplished in the embodiment of FIG. 2 by positioning the fan 8 such that the discharge is directed at an angle, away from the direction of the ionization detector 6. The air drawn by the fan 8 therefor follows an indirect path to the ionization detector 6, slowing its movement to an acceptable speed. Alternatively, air flow control devices such as, for example, baffles and deflectors could be used.

Other elements installed within the modular smoke detector 5 include the following. A relay 10 is connected by a set of output leads 11–13 to a terminal block 14. The output leads 11–13 are used to signal a fault to a control system (not shown) as described in detail below. If a fault is indicated, the control system executes emergency procedures as is well known in the art. A Direct Current (D. C.) power supply 15 provides DC operating power for the ionization detector 6, and a fuse 16 provides protection for the power supply 15 and the fan 8.

Figure 3:
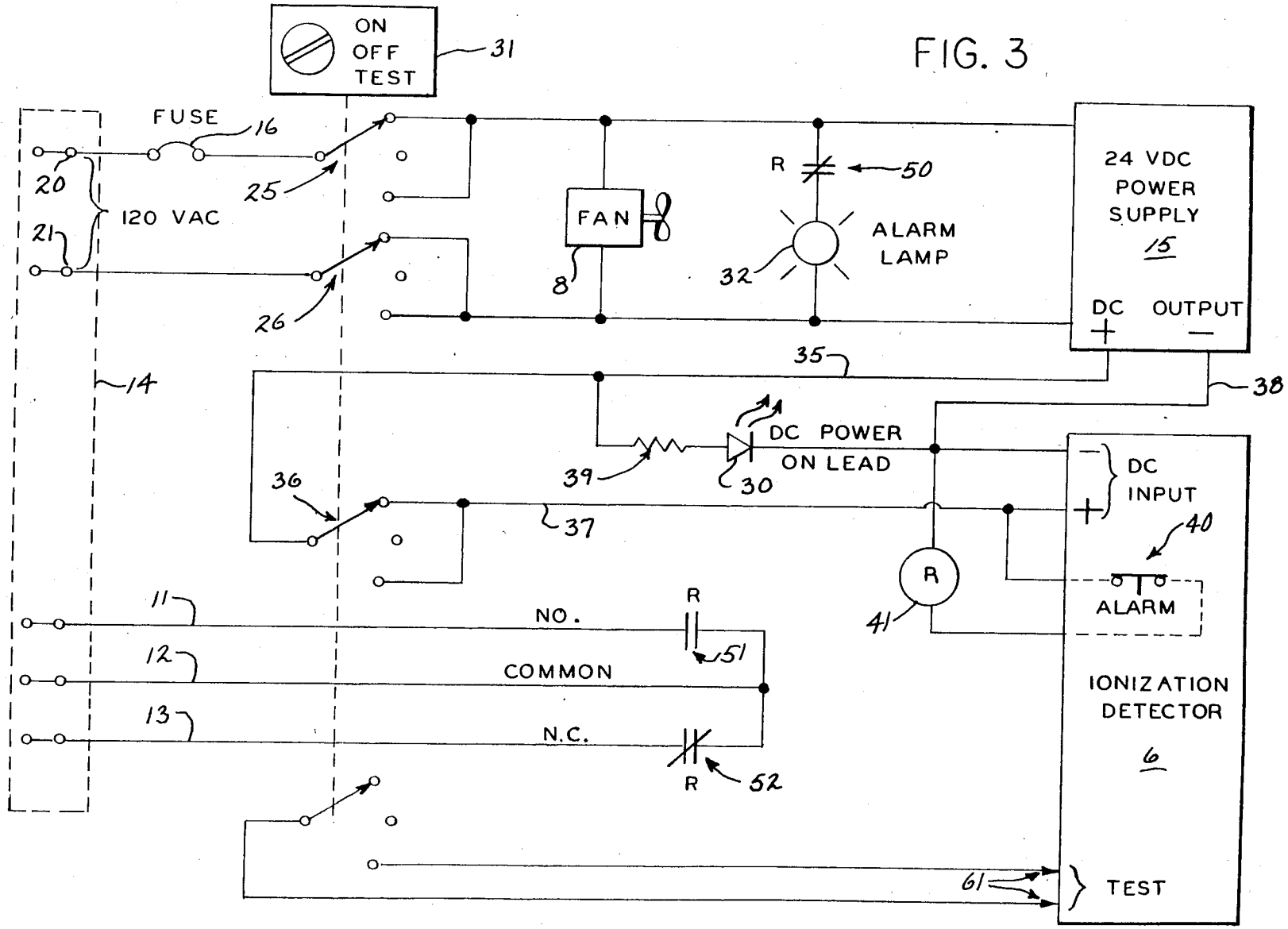
FIG. 3 is a schematic diagram of the modular smoke detector of FIGS. 1 and 2.

Referring to FIG. 3, terminal block 14 includes a pair of terminals 20 and 21 for the connection of 120 Volts AC (VAC) for operation of the modular smoke detector 5. The 120 VAC input is connected through fuse 16 to two poles 25 and 26 of switch 31. Switch 31 connects the 120 VAC input in both the ON and TEST positions to the fan 8, the AC input of power supply 15, and a branch containing the ALARM lamp 32.

The positive (+) DC output 35 of power supply 15 is connected to another pole 36 of switch 31. The ON and TEST outputs of pole 36 are connected together on line 37 to supply DC operating power to the positive (+) DC input of ionization detector 6. The negative (−) output 38 of power supply 15 is connected directly to the ionization detector 6. Indicator 30 is a Light Emitting Diode (LED) 30 which is connected through ballast resistor 39 across the DC outputs 35 and 38 to indicate that the DC power is on.

The ionization detector 6 includes a set of ALARM contacts 40 which are held normally closed and opened upon detecting ionization. The coil 41 of relay 10 is connected in series with the ALARM contacts 40 across the DC outputs 37 and 38, and is therefore normally energized. The normally energized state is preferred so that if the DC power is interrupted, an alarm will be indicated.

The contacts for relay 10 include a normally closed contact 50, a normally open contact 51, and a normally closed contact 52. Contact 50 is connected in series with ALARM lamp 32. If a fault is detected, relay 10 drops out and contacts 50 close, illuminating the ALARM lamp 32.

Contacts 51 and 52 each have one side connected to lines 11 and 13, respectively. The other side of both contacts 51 and 52 is connected to common line 12. Lines 11–13 are then connected to terminal block 14 for connection to the control system (not shown), thereby allowing the control system to utilize either the normally open or normally closed contacts 51 or 52 as a fault indication.

When the switch 32 is in the test position, a fourth pole 60 makes a connection across the TEST input terminals 61 of the ionization detector 6. This causes the ionization detector 6 to perform a self-test and open the ALARM contacts if operating properly. This facility may be used, for example, to simulate a fault to test the response of the control system.

It should be apparent to one skilled in the art that other types of detectors, for example, photo-electric smoke detectors, may be used instead of, or in addition to, the ionization detector 6. Further, an audio alarm may be used in addition to, or in place of, the external signaling lines 11–13 to indicate a fault in the absence of a suitable control system.

We claim:

1. A modular smoke detector for use in an electrical equipment cabinet of the type which includes a plurality of mounting stations, each mounting station including means for mounting separable electrical eqipment modules in the cabinet, the modular smoke detector comprising:

a frame which includes mounting means for separably mounting the frame in the equipment cabinet at any one of the mounting stations in substantially the same manner as the electrical equipment modules;

detector means attached to the frame for detecting the presence of combustion products; and air inlet means on the frame for admitting air from the interior of the equipment cabinet to the detector means.

2. The modular smoke detector of claim 1 which includes:

a fan mounted on the frame for inducing air from the air inlet means; and air flow control means for limiting the velocity of air being delivered to thedetector means.

3. The modular smoke detector of claim 2 in which the air flow control means comprises a mounting for the fan which directs the discharge from the fan in a direction other than directly at the detector means.

4. The modular smoke detector of claim 1 in which the detector means includes output menas for providing a fault signal when combustion products are detected.

5. The modular smoke detector of claim 4 which includes switch means, the switch means including a test position which causes the detector means to simulate a fault condition by activating the output means for test purposes.

6. In an electrical equipment cabinet of the type which includes a smoke detector for detecting combustion products from faulty electrical equipment in the cabinet, and which includes a plurality of mounting stations, each mounting station including means for mounting separable electrical equipment modules, the improvement wherein the smoke detector is contained within a frame which includes the same releasable mounting means as the electrical equipment modules to allow separable mounting of the smoke detector in any one of said plurality of mounting stations in substantially the same manner as the electrical equipment modules.

* * * * *

UNITED STATES PATENT AND TRADEMARK OFFICE

CERTIFICATE OF CORRECTION

PATENT NO. : 4,785,288

DATED : November 15, 1988

INVENTOR(S) : G. E. Heberlein, Jr. et al.

It is certified that error appears in the above-identified patent and that said Letters Patent is hereby corrected as shown below:

On the Title Page, Item [54], and

Column 1, Line 1, in the title, change "MODULAR SMOKE DETECTOR" to --MODULAR SMOKE DETECTOR FOR AN ELECTRICAL EQUIPMENT CABINET--

In Column 5, at Line 11, Claim 1, change "eqipment" to --equipment--;

In Column 6, at Line 2, Claim 2, change "thedetector" to --the detector--;

at Line 8, Claim 4, change "menas" to --means--;

Signed and Sealed this

Twenty-seventh Day of June, 1989

*Attest:*

*Attesting Officer*

DONALD J. QUIGG

*Commissioner of Patents and Trademarks*